US006860044B2

(12) United States Patent
Keiper

(10) Patent No.: US 6,860,044 B2
(45) Date of Patent: Mar. 1, 2005

(54) QUICK ATTACHABLE BLADE

(76) Inventor: Darwin Robert Keiper, Hc 87 Box 3, Pocono Lake, PA (US) 18347

( * ) Notice: Subject to any disclaimer, the term of this patent is extended or adjusted under 35 U.S.C. 154(b) by 34 days.

(21) Appl. No.: 10/391,180

(22) Filed: Mar. 17, 2003

(65) Prior Publication Data

US 2004/0181978 A1 Sep. 23, 2004

(51) Int. Cl.[7] ..... E02F 3/96; E02F 3/76

(52) U.S. Cl. ..... 37/409; 37/407; 172/817; 172/272

(58) Field of Search ..... 37/403, 404, 408–410, 37/407, 468, 241; 172/701.1, 272–275, 811, 817

(56) References Cited

U.S. PATENT DOCUMENTS 2,530,414 A * 11/1950 Wells ..... 37/409
3,665,622 A * 5/1972 Lamb ..... 37/407
3,738,030 A * 6/1973 Olinger ..... 37/409
3,938,680 A 2/1976 Grimes
3,942,271 A 3/1976 George
4,189,854 A 2/1980 Haynes
4,208,815 A 6/1980 Yunker et al.
4,243,356 A * 1/1981 Takojima ..... 414/723
4,328,628 A * 5/1982 Thomas ..... 37/241
4,360,980 A * 11/1982 Jarvis ..... 37/404
4,790,084 A * 12/1988 Anderson et al. ..... 37/403
5,253,449 A 10/1993 Webb et al.
5,918,389 A 7/1999 Hall
6,070,345 A 6/2000 Akaki et al.
6,088,939 A 7/2000 Logan
6,098,321 A 8/2000 Logan
6,168,369 B1 * 1/2001 Bright et al. ..... 414/724
6,243,975 B1 6/2001 Gall
6,308,440 B1 * 10/2001 Mueller ..... 37/404
6,405,460 B1 6/2002 Whitmire et al.
6,493,967 B2 * 12/2002 Holmes et al. ..... 37/468
6,526,678 B2 * 3/2003 Waddington, Jr. ..... 37/406
2001/0037588 A1 * 11/2001 Royer ..... 37/403

* cited by examiner

*Primary Examiner*—Thomas B. Will
*Assistant Examiner*—Alexandra Pechhold
(74) *Attorney, Agent, or Firm*—Dann, Dorfman, Herrell and Skillman; Christopher A. Rothe

(57) ABSTRACT

A blade attachment that can be attached to an excavator or backhoe in 10 seconds and removed in 3 seconds from the operator's seat without the need for tools, nuts, bolts, pins, chains, hoses or additional personnel. The blade attachment is secured to the bucket with two u-shaped adaptors welded to the inside of the bucket. The blade has opposing brackets which support a grab bar and adjustable striker bar, allowing it to be installed on numerous buckets without modification, and providing for quick removal. The design of the bucket adaptors and striker bar prohibits the blade from being removed during earth moving and grading operations, but allows the operator to maintain a level grade when the machine is sitting on as much as a 10% grade difference.

13 Claims, 4 Drawing Sheets

QUICK ATTACHABLE BLADE

CROSS-REFERENCE TO RELATED APPLICATIONS

| | | | |
|---|---|---|---|
| 6243975 | June, 2001 | Gall | 37/407 |
| 6098321 | August, 2000 | Logan | 37/409 |
| 5253449 | October, 1993 | Webb/Pohl | 37/446 |
| 4189854 | February, 1980 | Haynes | 37/404 |
| 3942271 | March, 1976 | George | 37/404 |
| 3938680 | February, 1976 | Grimes | 414/722 |
| 6070345 | June, 2000 | Akaki, et al | 37/407 |
| 5918389 | June, 1999 | Hall | 37/407 |
| 4208815 | June, 1988 | Yunker, et al | 37/446 |
| 6088939 | July, 2000 | Logan | 37/468 |

BACKGROUND OF THE INVENTION

This invention relates to earth moving equipment attachment specifically quick attachable grading blades for use with an excavator, or back hoe bucket, thereby transforming the digging bucket to a grading device and eliminating the expense of purchasing a grading machine such as a bulldozer costing up to $100,000 dollars. The quick attachable blade is a device that is worked by the excavator's bucket, dipper and boom rather than pushed by a tractor, so as not to cause ruts and excessive ground pressure. No matter what the ground condition wet, snow covered, or soft fill the job gets done. The quick attachable blade is the only blade that can be hooked up in 10 seconds and unhooked in 3 seconds by the operators from his seat. No pins, chains, nuts, bolts, hydraulic lines, or additional labor is needed, therefore having a digging and trenching capability one second, and grading capability 10 seconds later. All without getting off of the machine.

With only one machine, to now do the job of two, the cost in labor, fuel and transpiration of a second machine is no longer necessary. The quick blade exclusive quick attachment allows you to keep the blade with the machine at all times.

Previous attempts have been made to make a quick attachable grading blade for a excavator that could be attached and removed without any, nuts, bolts, chains, hydraulic lines, or manual labor and as of this time none have been successful.

As shown by the previous art forms of Von Schalscha: Craig C. U.S. Pat. No. 5,596,825 an attempt has been made to simplify a grading device, making it quick detachable and inexpensive. This device may have met it's goal but requires, the operator to have to get out of the operating seat, have tools for the fasteners, or additional labor to complete the task, there by making this art, cumbersome, and time consuming for installation. Logan; John Duncan U.S. Pat. No. 6,088,939 addresses the quick alignment of tool and ease of removing the tool, but this too requires fasteners to secure tool to bucket. Requiring operators need to have tools to install fasteners, either forcing him to leave the operators seat or have additional labor. Therefore, this artwork again, does not address quick installation and removability from the operator's seat. Yunker et al. U.S. Pat. No. 4,208,815 has addressed a straight edge inserted over the teeth of the bucket for grading. While this too provides a grading blade, as in the previous art, it too requires, fasteners, tools for fasteners, the operator must leave his operating seat, and have additional labor to help with the installation.

BRIEF SUMMARY OF THE INVENTION

This quick detachable grading device, which requires no tools, pins, bolts, chains, hydraulic lines or any other type of fasteners to install or remove at anytime, can be attached completely within ten seconds from the operators seat. Therefore, not requiring, fasteners, tools, additional labor, or operator to leave the seat of the equipment. This is made possible by specially designed adapters, which are welded on the inside of the backhoe or excavator bucket. The welding of the adapters are placed as to not disturb the normal everyday use of the bucket. Said attachment is designed with a grab bar, an adjustable striker plate, and adjustable moldboard for initial installation. After adjustments are completed, the striker plate and moldboard are welded into fixed position, which completes the initial installation. The blade attachment is now removable by rotating bucket upward which allows the bucket to slide off the grab bar, therefore disconnecting the attachment. To re-attach one slides the adapters over the grab bar rotating the bucket downward until contacting striker plate. The distance now from the grab bar to the striker plate is less than the length of the adapter slots. Therefore downward pressure on the bucket causes the adapter to hit the striker plate before grab bar can come out of adapter slots. This causes the attachment to stay on regardless of forward motion and downward pressure. The length of the adapter slots allow one side of the attachment to rise and hit the striker plate while other side remains in adapter slot creating a 10% variation in cutting edge surface to level grade. Thus accomplishing the ability to create a level grade when machine is out of level of up to a 10% grade. When attachment is crowed inward and bucket rotated to travel position, adapter slots prevent the attachment from falling off by hitting striker plate therefore eliminating additional binders, or chains on the machine for transporting.

DETAILED DESCRIPTION OF THE INVENTION

Figure 1:
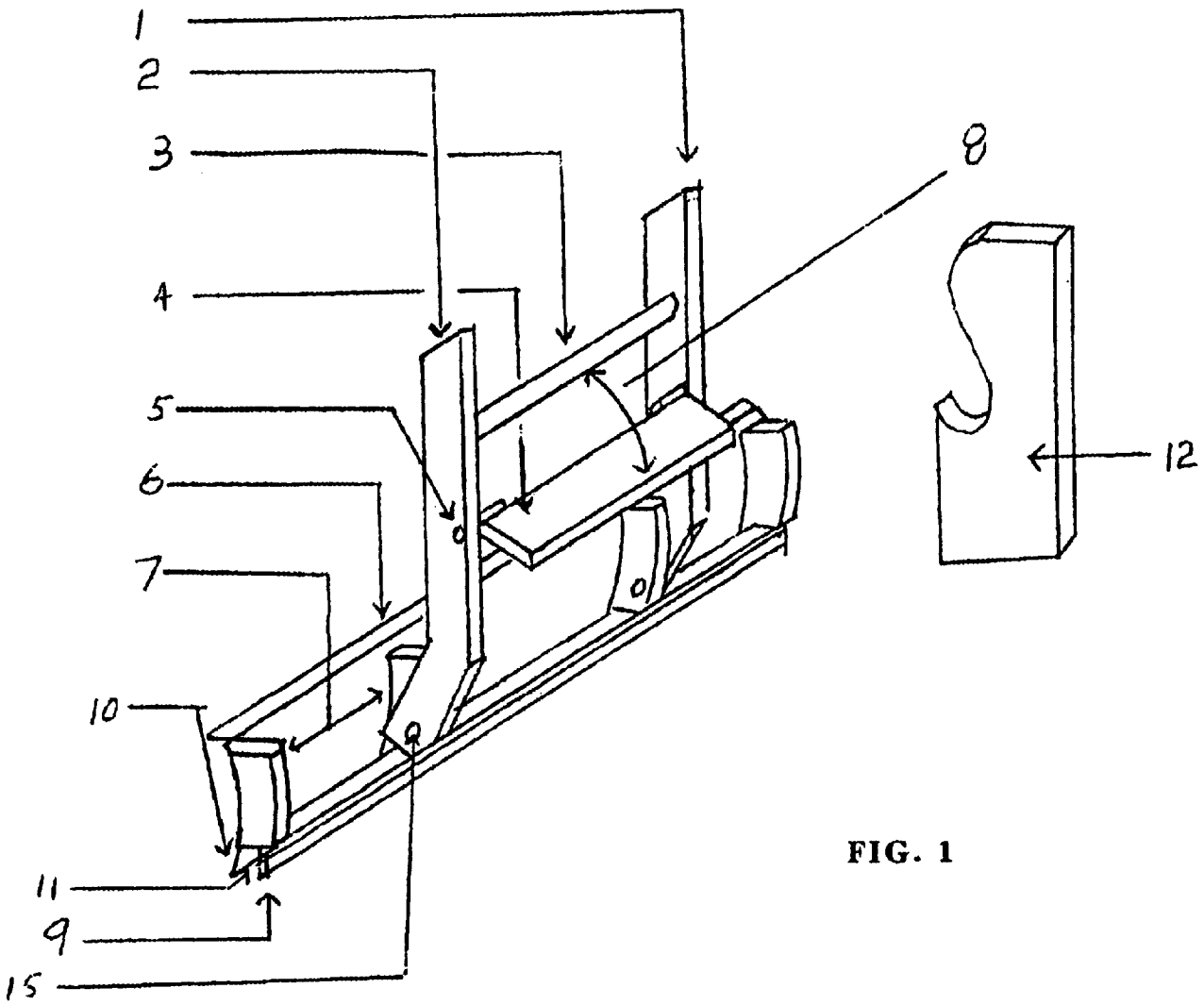
FIG. 1 Shows a quick attachment blade and mounting bracket in 3D
Figure 2:
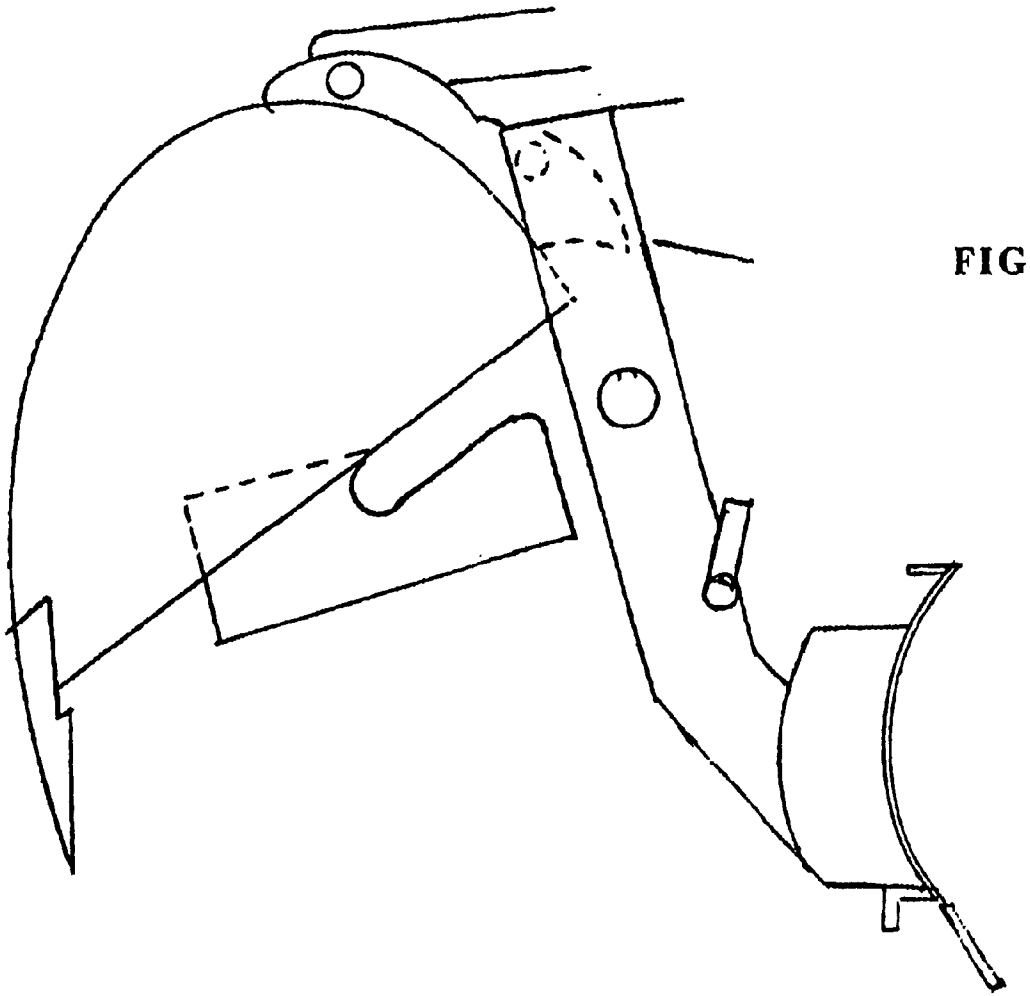
FIG. 2 Shows buckets with adapters installed and approaching quick attachment blade.
Figure 3:
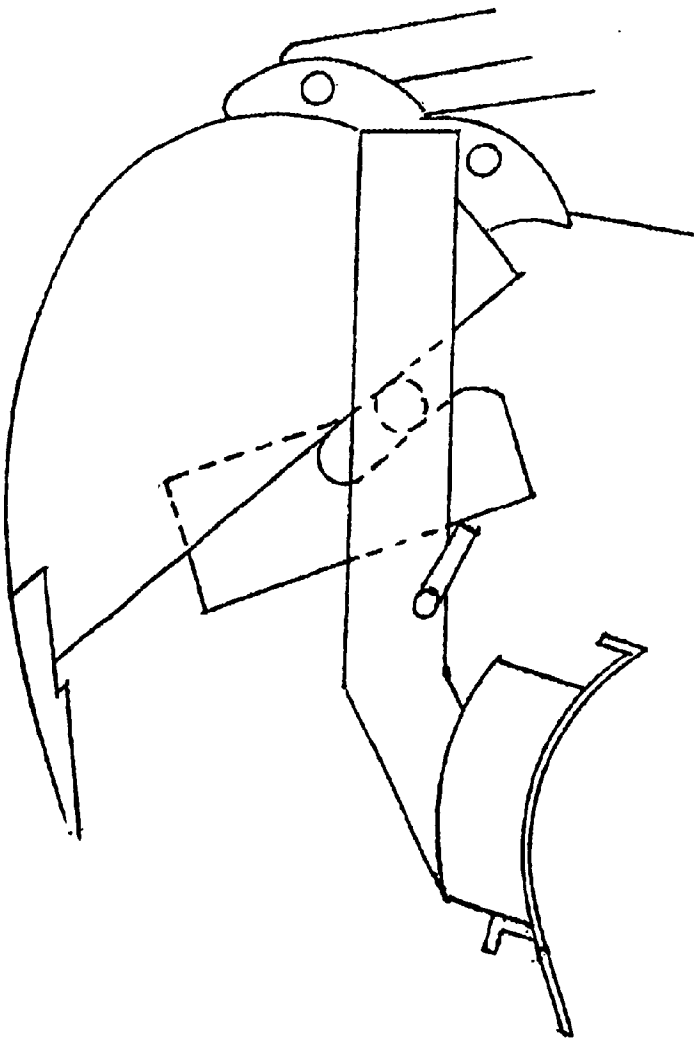
FIG. 3 Shows bucket with adapters installed sliding on the grab bar and in-between grab bar and striker plate.

The upper portion of frame members 1&2 in FIG. 1 are connected by grab bar 3 in FIG. 1 which is permanently affixed. Then said adjustable striker plate 4 in FIG. 1 is affixed to upright frame 1&2 in FIG. 1 at a given measurement, from grab bar 3 in FIG. 1 by the means of a threaded rod 5 in FIG. 1. After adjustment of striker plate during initial installation adjusted striker plate is permanently a fixed by welding thus creating critical adapter slot travel confinement 8 in FIG. 1. At lower portion of frame members 1&2 in FIG. 1 adjustable moldboard 6 in FIG. 1 is connected by means of temporary pivot pins 15 in FIG. 1 to moldboard supports 7 in FIG. 1. Upon completion of adjustment during initial installation adjustable moldboard 6 in FIG. 1 is permanently a fixed to frame members 1&2 in FIG.

1 by the means of welding frame members to mold board support 7 in FIG. 1. Thus completing installation and adjustment of quick attachable blade.

Figure 4:
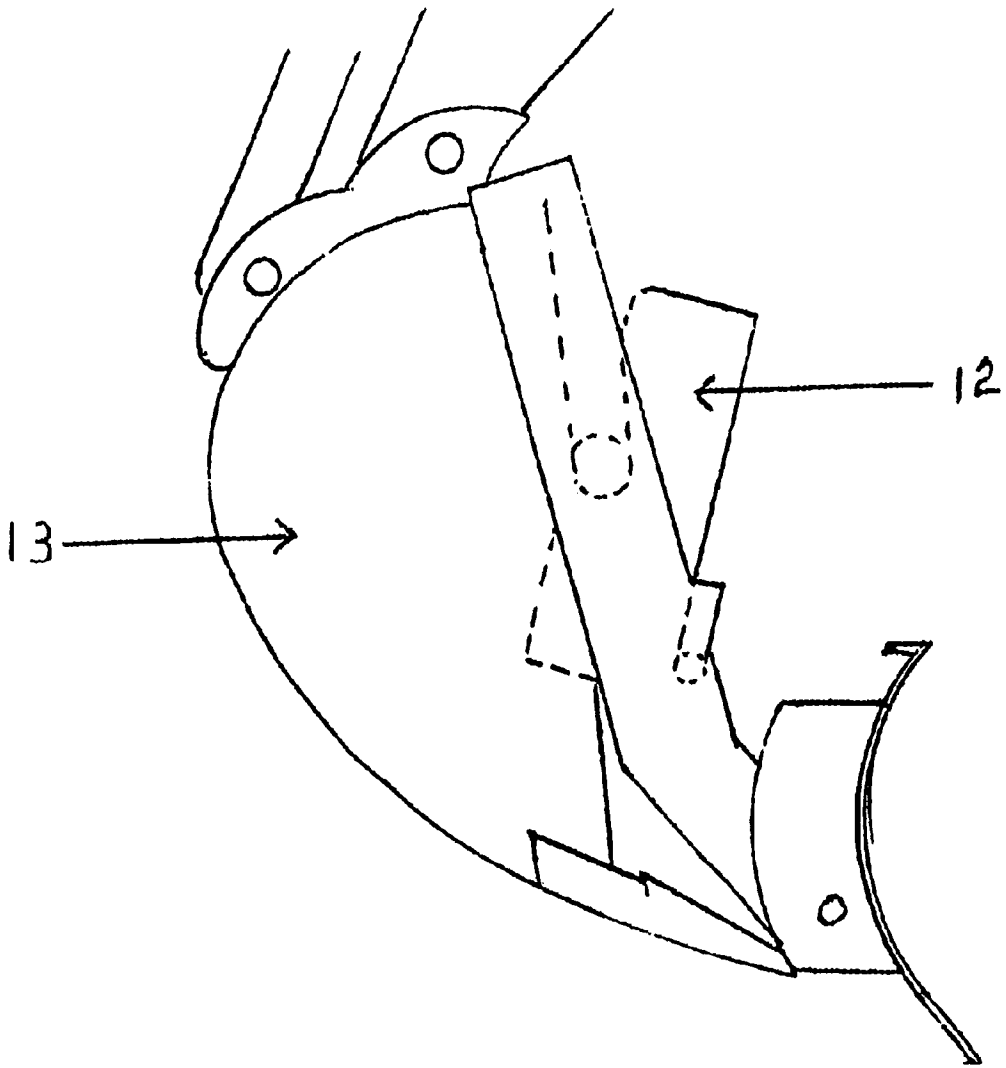
FIG. 4 Shows quick attach blade completely installed on bucket by means of rotating bucket causing adapters to pivot on grab bar and rotate till adapters hit striker plate thus completing installation.

The attachment blade is affixed to backhoe bucket 13 in FIG. 4 by the means of adapter 12 in FIG. 4 which permanently attached to inside upper portion of bucket, so as not to disturb the normal everyday use of said bucket 13 in FIG. 4.

L bracket 9 in FIG. 1 attached to moldboard 6 in FIG. 1 and moldboard supports 7 in FIG. 1 create a location 11 in FIG. 1 for dirt to accumulate during fine grading, this creating a support of the entire blade which restricts unwanted elevations in final grade. By rotating the attachment creating L bracket 9 in FIG. 1 to rise and disperse said accumulated dirt and allowing cutting edge 10 in FIG. 1 to penetrate thus allowing cutting action of the dirt. L Bracket 9 in FIG. 1 also allows attachment to stand upright when disconnected making reattachment easy.

This quick attachable blade makes it more cost effective and more operator friendly then any past art. This quick attachable blade is designed to allow an operator to easily attach and detach all within 3–10 seconds without having to leave the operating seat, needing no fastening devices, fastening tools, or additional labor.

One of it's many uses during a normal operation of an excavator, is digging foundations. The quick attachable blade allows the operator to clean loosened material created by the teeth of the excavator from the bottom of an excavation, by rotating his bucket aligning with the grab bar thus attaching the blade all with in 3–10 seconds. Thus eliminating the need for handwork. This can be done immediately as the excavation becomes larger due to the quick ability to attach the blade throughout the completion of the whole excavation.

While using an excavator to load trucks from a stockpile the operator between loads can easily rotate his bucket forward causing the adapters to align with the grab bar thus attaching to the blade. This enables him to clean the work pad of all loose and fine debris and immediately counter rotate the bucket taking off the blade attachment without leaving the seat all with in 3–10 seconds.

The quick attachment blade makes it possible to utilize a grading blade in areas where using a bulldozer is not advisable, or not allowed. By being able to attach the quick blade in 3–10 seconds an operator can grade extremely wet soil, without creating, ruts, or undue pressure against newly poured foundation walls.

The quick blade attachment also has the ability to clean unwanted materials off of surfaces such as black top where a bulldozer or any other track machine could not go, by easily extending the boom on the excavator and using the blade to scrape the surface.

What is claimed at the invention is:

1. An excavator bucket assembly pivotally mounted on a vehicle, said excavator bucket assembly comprising:

A. an excavator bucket having means comprising an elongated slot having a slot width;

B. an earth-working attachment configured for engagement with the excavator bucket;

C. an attachment frame coupled with the earth-working attachment, said attachment frame comprising a generally cylindrical grab bar having a bar diameter less than the slot width of the elongated slot, and D. a strike plate extending from the attachment frame generally parallel to the grab bar, said grab bar and said strike plate forming a passage between the grab bar and strike plate that slidably receives said means comprising an elongated slot, wherein the elongated slot of the excavator bucket is configured to align with and receive said grab bar in a sliding engagement to pivotally connect the frame and earth-working attachment with the excavator bucket.

2. The excavator bucket assembly of claim 1, wherein the means comprising the elongated slot includes an adapter mountable to the excavator bucket.

3. The excavator bucket assembly of claim 2, wherein the passage slidably engages the adapter in response to pivotal movement of the excavator bucket.

4. The excavator bucket assembly of claim 3 wherein the elongated slot comprises an end wall and wherein the strike plate comprises a restraining surface, said restraining surface and said grab bar slidably engaging opposite sides of the adapter.

5. The excavator bucket assembly of claim 2 comprising a first adapter plate mountable to a first side of the excavator bucket and a second adapter plate mountable to a second side of the excavator bucket opposing the first side.

6. The excavator bucket assembly of claim 1, wherein the earth-working attachment comprises a grading blade.

7. The excavator bucket assembly of claim 1 comprising a first rail on the attachment frame and a second rail on the attachment frame extending generally parallel to the first rail, said grab bar extending transversely between said first and second rails to connect the first and second rails.

8. The excavator bucket assembly of claim 1 comprising an adjustable threaded rod that connects the strike plate to the attachment frame.

9. An excavator bucket assembly pivotally mounted on a vehicle, said excavator bucket assembly comprising:

A. an excavator bucket;

B. an adapter mountable to the excavator bucket, said adapter comprising an elongated slot;

C. an earth-working attachment configured for engagement with the excavator bucket;

D. an attachment frame coupled with the earth-working attachment, said attachment frame comprising a generally cylindrical grab bar slidably received in the elongated slot of said adapter; and E. a strike plate extending from the attachment frame generally parallel to the grab bar, said grab bar and said strike plate slidably engaging opposite sides of said adapter.

10. The excavator bucket assembly of claim 9, wherein said adapter is slidably displaceable between the grab bar and the strike plate from an unlocked position, in which the adapter is pivotally displaceable relative to the attachment frame, and an automatic locked position, in which the adapter is releasably retained in a fixed position relative to the attachment frame solely by confinement of the adapter between the grab bar and the strike plate.

11. The excavator bucket assembly of claim 10, wherein the grab bar is pivotally displaceable in the adapter slot between a level orientation, in which the longitudinal axis of the grab bar extends perpendicularly to the longitudinal axis of the elongated slot, and a canted orientation, in which the longitudinal axis of the grab bar extends at a non-perpendicular angle relative to the longitudinal axis of the elongated slot.

12. The excavator bucket assembly of claim 11, wherein the attachment frame is securable in a fixed position relative to the bucket in the level orientation without fasteners.

13. The excavator bucket assembly of claim 11, wherein the attachment frame is securable in a fixed position relative to the bucket in the canted orientation without fasteners.

* * * * *